United States Patent [19]

Noel

[11] Patent Number: 4,846,912

[45] Date of Patent: Jul. 11, 1989

[54] METHOD OF INSULATING A COIL

[75] Inventor: Richard K. Noel, Logansport, Ind.

[73] Assignee: Hamilton Standard Controls, Inc., Farmington, Conn.

[21] Appl. No.: 48,863

[22] Filed: May 12, 1987

[51] Int. Cl.[4] ..... B65C 1/04; H01F 41/12

[52] U.S. Cl. ..... 156/212; 29/467; 29/605; 156/344; 156/542; 336/206; 336/209

[58] Field of Search ..... 29/605, 602 R, 467; 336/209, 206; 156/212, 213, 542, 344

[56] References Cited

U.S. PATENT DOCUMENTS

| | | | |
|---|---|---|---|
| 1,797,768 | 3/1931 | Goad . | |
| 1,863,713 | 6/1932 | Connor . | |
| 1,939,808 | 12/1933 | Freeland | 175/21 |
| 2,511,174 | 6/1950 | Osborne | 175/21 |
| 3,378,800 | 4/1968 | Liberman | 336/192 |
| 3,609,859 | 10/1971 | Hunt et al. | 29/605 |
| 3,657,677 | 4/1972 | Hunt et al. | 336/96 |
| 3,868,289 | 2/1975 | Beard et al. | 156/443 |
| 3,868,766 | 3/1975 | Gramlich et al. | 29/596 |
| 3,971,686 | 7/1976 | Kienel | 156/212 |
| 4,151,640 | 5/1979 | McDermott et al. | 29/605 |
| 4,222,023 | 9/1980 | Beech | 336/209 |

*Primary Examiner*—Carl E. Hall

[57] ABSTRACT

An improved coil end face insulator and the application technique therefor serve to accurately and cost-effectively insulate the end windings of an electrical coil from the transverse arm of a ferromagnetic core spaced closely thereto. The insulator is of annular, one-piece construction, and comprises adhesively-backed tape. The insulators are dispensed in a convenient manner for rapid and accurate application to the respective end faces of coils respectively positioned on a mandrel or fixture.

4 Claims, 2 Drawing Sheets

METHOD OF INSULATING A COIL

DESCRIPTION

TECHNICAL FIELD

The invention relates generally to insulation for electrical coils and more particularly to insulation for the ends of such coils. More particularly still, the invention relates to the method for applying particular insulation to the ends of coils.

BACKGROUND ART

In the fabrication of electrical coils, and particularly such coils forming part of a transformer, it is not only generally necessary to provide insulation between adjoining windings and layers of windings of the coil, but also between the windings and the iron core associated with the transformer. U.S. Pat. No. 1,797,768 to Goad and U.S. Pat. No. 4,222,023 to Beech disclose arrangements for providing insulating wrappers about most or all of a coil, such as a motor winding. U.S. Pat. No. 3,657,677 to Hunt et al discloses an electrical transformer wherein a plurality of electrical coils are wound on separate coil forms. Each of the coils is attached to a separate insulating washer member, and the coils and washer members are disposed on a common insulating tube in side-by-side relation. The insulating washer members provide barrier insulation between coils.

U.S. Pat. Nos. 1,863,713 to Connor; 1,939,808 to Freeland and 2,511,174 to Osborne disclose coil arrangements in which an insulating member exists at one or both ends of a coil for insulating that coil end, as from a transversely-extending portion of the magnetic core. In U.S. Pat. No. 1,863,713 several fabric strips extend radially outward over the coil end face for providing such insulation. U.S. Pat. No. 1,939,808 discloses an arrangement in which a pair of insulative end caps are placed on the opposite ends of a coil and held in position by an insulative strip wound about the coil. U.S. Pat. No. 2,511,174 discloses a coil construction in which a bobbin core and end flanges are formed of insulative material such as cardboard. Several turns of the coil are wound about the bobbin core and the corners of the bobbin flange are then folded axially inward such that a subsequent layer of windings secure the bobbin flanges in position. These arrangements demonstrate varying degrees of complexity and cost associated with their manufacture.

In other recent arrangements, individual strips of adhesively backed insulation material have been manually positioned on each of the four perimeter regions at the end face of a coil, with eight such strips of insulation being required to insulate the two opposite ends of the coil. While such provision for insulating the ends of the coil may be relatively simple and effective, it is rather labor intensive and presents the opportunity for misalignment of the individual strips with the coil ends.

SUMMARY OF THE INVENTION

It is an object of the invention to insulate the ends of an electrical coil in a manner and means which is particularly accurate and cost effective. Included within this object is the provision of a technique for insulating the ends of a transformer coil in a manner which reduces or minimizes the labor involved.

Accordingly, the present invention provides a coil-end insulator and particularly an assembly technique using such insulator for effectively and economically insulating the ends of a coil, particularly as used in a transformer. Adhesively-backed insulation tape is precut in a one-piece geometry which is sufficient to at least insulate the entire end face of a coil. The insulation tape is cut in the same general geometry as the annular, typically rectangular, shape of the end face of the coil and is sufficiently large to permit its outer edge portions to be folded rearwardly into engagement with the side of the coil. Further, the width of those end margins may be greater in one direction than in the other direction orthogonal thereto so as to facilitate good adhesive engagement of the insulator with the coil.

In accordance with the method of the invention, the preformed, annular, one-piece insulation members are serially and releasably disposed on a strip of backing medium. That backing medium with preformed insulators is semi-automatically dispensed using relatively conventional means. The preformed insulators are individually removable from the backing medium for subsequent placement on the end face of a coil.

The annular coil is positioned over a mandrel having a forwardly-extending alignment portion. A dispensed insulator is then moved, typically manually, over the aligning portion of the mandrel and into adhesively-bonded engagement with the exposed end face of the coil. The perimeter portions of the insulator may then be folded rearwardly, or downwardly, into engagement with the side of the coil. To place an insulator on the opposite end of the coil, the coil is simply removed from the mandrel, reversed end for end, reinserted on the mandrel and a second insulator is placed in a similar manner on the exposed end face of that opposite end of the coil.

BEST MODE FOR CARRYING OUT THE INVENTION

Figure 1:
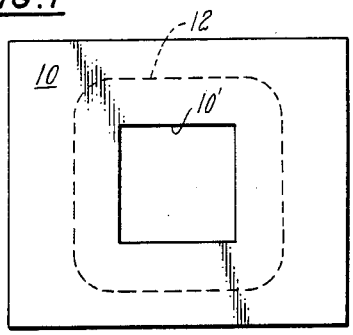
FIG. 1 depicts a one-piece insulator in accordance with the invention.
Figure 2:
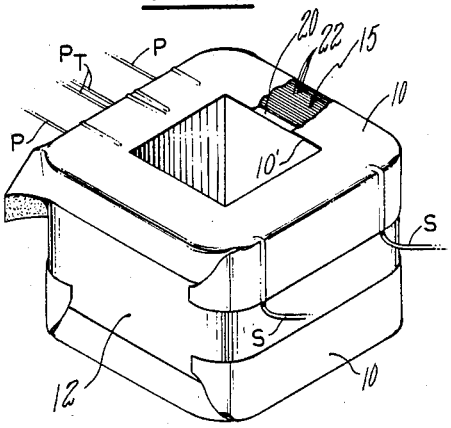
FIG. 2 depicts a transformer coil having the insulator of FIG. 1 disposed on the opposite end surfaces thereof in accordance with the invention.

Referring to FIG. 1 there is depicted a one-piece, preferably continuous, insulator 10 disposed on the end face of a coil in accordance with the invention. FIG. 2 depicts a pair of the insulators 10 operatively disposed on a coil 12 at the opposite ends thereof. Coil 12, with end-face insulators 10, is shown in operative relation with a ferromagnetic core 14 in FIG. 3, to provide a transformer.

Returning to FIG. 1, insulator 10 is provided by a substantially planar material, or tape, having the requisite insulating properties and being coated with an adhesive on one surface. In the embodiment contemplated, the transformer has a 60 volt-amp rating and the insulator 10 is conveniently provided by either PERMACEL ® P245 Tape, a polyester film/polyester non-woven tape made by Permacel Co. of New Brunswick, N.J. or 3M No. 44 Tape, a reinforced polyester film tape manufactured by the 3M Company of St. Paul, Minn. Insulator tape 10 is precut to an annular shape which generally corresponds with the shape of the end face of coil 12 and typically includes a margin portion which extends laterally beyond the coil 12 for folding rearward into engagement with the side of the coil. FIG. 1 depicts the insulator tape 10 operatively positioned in alignment with the end face of coil 12, shown in broken line, prior to the folding of the perimeter portions into engagement with the side of the coil. As shown most clearly in FIG. 1, it will be noted that the dimensioning of insulator 10 is preferably such that it extends laterally beyond the coil 12 a greater distance in one direction than it does in an other direction orthogonal thereto.

In FIG. 2 the end-face insulators 10 are shown operatively affixed to the electrical coil 12 at its opposite ends. Coil 12 is of relatively conventional design, having a rectangular, in this instance square, rigid central form 20 about which multiple turns and layers of primary and secondary wire are wound to form the transformer coil. Typically, suitably sized coil magnet wire is initially wound about the center form 20 to provide the primary windings, the opposite ends of which are designated P and a center tap being designated $P_T$. Thereafter, suitable coil magnet wire for the transformer secondary is wound over the primary windings to provide the secondary, having opposite end leads designated S. Further, particularly in regions of higher voltage gradients, an intermediate layer of insulating kraft paper 22 is interposed between successive coil winding layers during the winding operation and is extended to provide an outer covering to the coil. Insulating paper 22 also extends axially beyond the limits of the windings to define the opposite end faces 15 of coil 12.

Figure 4:
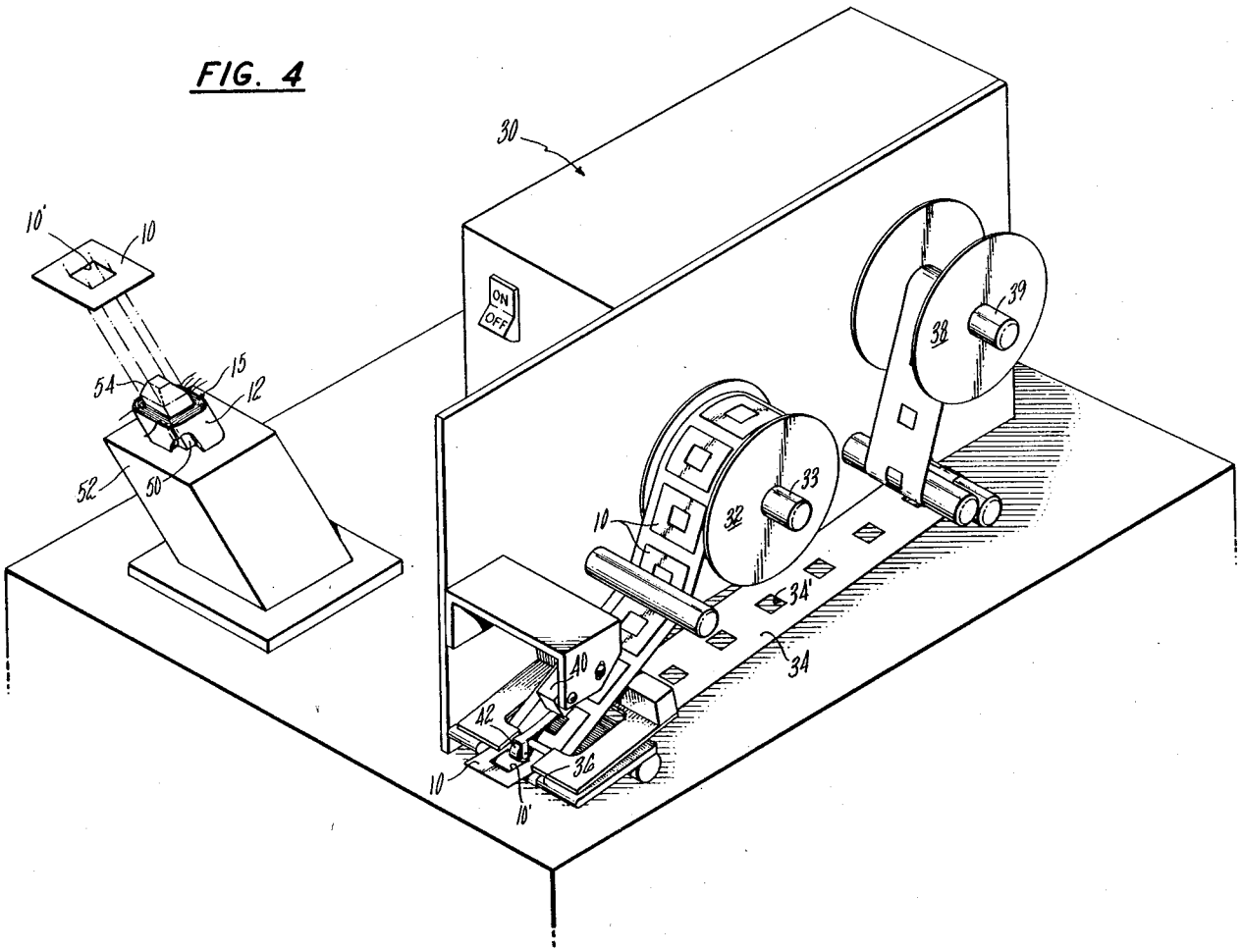
FIG. 4 depicts the apparatus for dispensing the insulators and the apparatus for temporarily mounting the coil while the insulator is affixed to the end face thereof.

Reference is made to FIG. 4 for an understanding of the apparatus and method which facilitate the rapid and accurate placement of an insulator 10 on the end face 15 of a coil 12. A motorized dispensing unit 30 of relatively conventional construction serves to dispense insulators 10 in a semi-automatic manner. A reel 32 contains an elongate strip of backing paper 34 on which a series of insulators 10 are releasably disposed. The backing paper 34 serves to temporarily mount the insulators 10 during storage and dispensation.

The insulators 10 may be preformed to the desired shape discussed with reference to FIG. 1 prior to their application to the backing paper 34. Alternatively, insulators 10 may be formed from a larger piece of insulator releasably adhered to the backing paper. In that latter arrangement, an elongated strip of the tape from which insulators 10 are made is releasably affixed to the surface of the backing paper 34 and a rectangular center opening 10', 34' is punched or cut through the insulator 10 and backing paper 34, respectively. The separation and spacing between successive insulators 10 on the backing paper 34 may be obtained by a precise cutting operation which cuts through the insulator tape but does not cut the backing paper 34. The then-severed connecting portion may be removed, as with a suction device.

Supply reel 32 is mounted on a supply spindle 33 of dispenser 30. The backing paper 34 is led over an abrupt turning edge 36 of the dispenser 30 and thence to a take-up reel 38 mounted on a take-up spindle 39. As the backing paper 34 passes in tension over the turning edge 36, an insulator 10 thereat is caused in a known manner to separate from the backing paper for removal and placement on a coil 12.

A microswitch 40 and associated feeler contact 42 are positioned near the backing paper 34. and turning edge 36 to control the semi-automatic dispensation of insulators 10. The feeler 42 is positioned along the center of the backing paper 34 and insulator 10 such that it undergoes switch-actuating displacement as it moves from the opening 10', 34' associated with one insulator 10 upward onto the surface of the insulator 10 and/or the backing paper 34. That causes the motor within dispenser 30 to advance reel 32 via take-up of reel 38 until the feeler 42 falls into the opening 10', 34' in the next succeeding insulator 10. The initial displacement of the feeler 42 from an insulator opening 10' is effected by the manual removal of a leading insulator 10 for placement on the coil 12.

Referring to the actual placement of an insulator 10 on the end face 15 of a coil 12, attention is directed to the mandrel 50 which is supported by and may form an integral part, of a pedestal 52. The mandrel 50 extends upwardly from the pedestal 52 a distance at least equivalent to the axial length of the coil 12. Moreover, the cross-sectional geometry of the mandrel 50 is such as to conform relatively closely with the cross-sectional geometry of the opening through the core of the coil 12. In this manner, the coil 12 may be positioned axially over the mandrel 50 and be held in the working position depicted in FIG. 4. The mandrel 50 preferably further includes an upwardly, or forwardly, extending projection 54 which is tapered to facilitate the relative insertion of the coil 12 thereover. The tapered mandrel extension 54 also facilitates alignment of the insulator 10, as will be appreciated hereinafter.

With the coil 12 positioned as depicted in FIG. 4, with an end face 15 disposed toward an operator, the operator may select an insulator 10 from the dispensing unit 30 and thence place it downwardly over the mandrel extension 54 and into adhesively-bonded engagement with the end face 15 of coil 12. Then, as further depicted in FIG. 2, the dimension of the insulator which exceeds the boundary of the coil 12 by the smallest amount is displaced rearwardly, or downwardly, into adhesively bonded engagement with the side of the coil 12. Finally, the remaining, longer portion of the perimeter of insulator 10 is manipulated downwardly for adhesively bonded engagement with the side of coil 12 and to also overlie the previously-adhered perimeter tab portion adjacent its corners. This latter feature is appreciated when viewing the upper-left corner of coil 12 in FIG. 2 where the adhesively-coated undersurface of the "longer portion" of insulator 10 is shown just prior to finally adhering that corner tab to the side of coil 12. This application of insulator 10 to the coil 12 provides an accurately aligned insulator which entirely covers the end face 15 of the coil and which also may be securely adhered to parts of the sidewall of the coil.

To apply the next insulator 10 to the opposite end face of coil 12, it is only necessary to remove the coil from the mandrel 50, reverse the coil end for end, reinsert the coil on the mandrel and apply the next insulator 10 in the same manner previously described. Following application of the other insulator 10 to the remaining end face 15 of coil 12, the coil may be removed from mandrel 50 for incorporation with a laminated ferromagnetic core 14 in a well-known manner.

Figure 3:
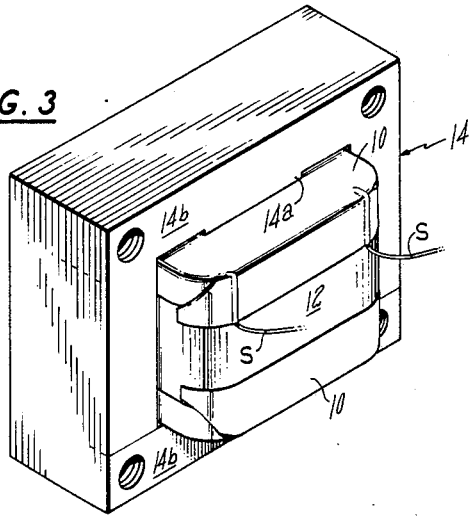
FIG. 3 depicts the transformer coil of FIG. 2 in operative relation with a ferromagnetic core.

Referring to FIG. 3, the magnetic core 14 includes a first portion **14*a* which extends axially through the core, or center, of the coil 12 and a second transverse portion 14*b* extending across the opposite ends of the coil in closely-spaced relation therewith. The insulators 10 at the opposite ends of the coil 12 are interposed in the region between the coil and the transverse portions 14***b* of the magnetic core 14. In this way, individual windings contained within the coil 12 are insulated from the magnetic core 14 particularly in the region of the coil end face.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. The method of insulating the opposite annular end faces of an annular coil comprising:

(a) providing a one-piece, continuous, substantially planar, annular insulator of adhesively-backed insulating material having an adhesive surface, with the lateral dimensioning of said insulator being at least as great as the lateral dimensioning of said coil annular end faces;

(b) positioning the coil on a mandrel, said mandrel including a tapered forward end which projects concentrically beyond said coil when said coil is positioned on the mandrel, such that one of said annular end faces is exposed;

(c) placing said insulator on the exposed coil end face with said adhesive surface of said insulator in adhering relation with said coil, while the coil is so positioned on the mandrel and wherein the insulator is partly guided into correct alignment with said coil end face by said forward end of said mandrel;

(d) removing said coil from said mandrel;

(e) reversing said coil end-for-end;

(f) repeating steps (a)-(d) such that another said annular insulator is placed on the other of said opposite annular end faces of the coil; and (g) wherein said annular insulators are releasably mounted on a release medium for storage and dispensing and the respective steps of providing said annular insulators each comprise removing said insulator from said release medium preparatory to said placement of said insulator on the respective said coil end face.

2. The method of claim 1 wherein said release medium is a rolled strip of releasable backing paper, a plurality of said insulators being serially arranged on said strip of backing paper, and said strip being unrolled to expose said insulators in succession for dispensation.

3. The method of claim 1 wherein said lateral dimensioning of said annular insulator is greater than that of said coil end face at least in an outward direction, and wherein each said step of placing said insulator on said coil end face further includes folding the outer region of said insulator rearwardly into adhering relation with the side of said coil.

4. The method of claim 3 wherein said lateral dimensioning of said insulator is such that it extends outward beyond the coil end face a greater distance in a first direction than in a second direction orthogonal to said first direction, and said step of folding said insulator rearwardly comprises folding the portion extending in said second direction prior to folding the portion extending in said first direction such that the latter overlies the former where overlap exists.

* * * * *